US005329268A

United States Patent [19]

McQueen

[11] Patent Number: 5,329,268

[45] Date of Patent: Jul. 12, 1994

[54] TRANSFORMER VARIABLE POWER

[76] Inventor: Clarence W. McQueen, 110 Sitting Bull Dr., P.O. Box 781, Hailey, Id. 83333

[21] Appl. No.: 958,725

[22] Filed: Oct. 9, 1992

[51] Int. Cl.[5] ..... H01F 21/06

[52] U.S. Cl. ..... 336/119; 336/133

[58] Field of Search ..... 336/117, 118, 119, 131, 336/132, 133, 134

[56] References Cited

U.S. PATENT DOCUMENTS

| | | | |
|---|---|---|---|
| 890,638 | 6/1908 | Gehrkens | 336/119 |
| 1,716,553 | 6/1929 | Higbee | 336/119 |
| 1,873,354 | 8/1932 | Steuart | 336/119 |
| 2,248,070 | 7/1941 | Fangor | 336/133 |
| 2,565,181 | 8/1951 | Mansperger | 336/119 |
| 3,178,696 | 4/1965 | Claflin, Jr. | 336/133 |
| 3,212,039 | 10/1965 | Kober | 336/133 |
| 3,502,966 | 3/1970 | Perets et al. | 336/133 |
| 3,550,053 | 12/1970 | Carlo | 336/118 |
| 4,612,527 | 9/1986 | Third et al. | 336/133 |

FOREIGN PATENT DOCUMENTS

| | | | |
|---|---|---|---|
| 520549 | 3/1931 | Fed. Rep. of Germany | 336/119 |

*Primary Examiner*—Thomas J. Kozma

[57] ABSTRACT

A transformer with a primary and a secondary core. The primary core is rectangular in shape with guide slots on the inside in the center of opposite legs and windings wound in opposition on the other two sides. The secondary core is rectangular in shape consisting of two V' shaped parts. A power end and a bypass end. The two legs of the secondary power core are shaped into a closed V' and the two legs of the secondary bypass core are shaped into an open V' to allow the legs of the bypass and power core halves to mesh. These two half cores are separated by a diamagnetic strip and bonded together with a low magnetic bonding agent. The power end of the secondary core contains the secondary windings. The complete secondary core is then inserted at a right angle through the guide slots in the primary core. As the secondary core is moved back and forth through the primary core, the ratio of the amount of ferromagnetic material in the bypass end and the power end in contact with the primary core changes and therefore changes the magnetic flux density in the power end of the secondary core thus altering power through the secondary windings.

3 Claims, 2 Drawing Sheets

TRANSFORMER VARIABLE POWER

BACKGROUND OF THE INVENTION

This invention relates to transformers with a controlled variable output and more particularly to transformers that can automatically maintain constant power from the secondary with a fluctuating power supply to the primary and vary the power from the secondary with a constant or variable power input to the primary. This invention also relates to an invertor transformer reference; Invertor Systems Utilizing Inductive or Capacitive Reactance, Ser. No. 07/775,293, filed Oct. 8, 1991, and to rotating field or induction motor speed or torque control. Many variable power transformers are currently in use and consist of different taps on the secondary coil or a sliding tap that can intersect various positions on the secondary windings. These transformers have either wide range steps or very minor adjustments and are not suitable for micro/macro adjustments in power. Another variable power transformer device consists of a moveable core inside of primary and secondary windings thereby changing flux linkages between primary and secondary windings. This transformer design does not supply a continuous ferro-magnetic path and lends itself to excessive leakage. Another transformer device called a magnetic modulator, U.S. Pat. No. 2,774,057, changes the flux linkage in the core by utilizing a sliding bar. This system would be very inefficient as it would not utilize ferromagnetism. Another transformer Pat. No. 3,716,719 does provide for controlled leakage (bypass) of the magnetic flux and electro magnetically functions well. This transformer, due to the bypass design, would have difficulty in micro adjustment and also would have excessive loads on the bearing surfaces due to the unbalanced forces in the magnetic field. The bearing surfaces on this transformer would abrade very rapidly.

SUMMARY OF THE INVENTION

This invention is a transformer that has a constant output with a variable input or a controlled variable output with a variable or constant input. Said transformer comprises a primary core and a secondary core with the secondary core moveable across and through the primary core. The primary core has primary windings on each leg (end) that are wound in opposition so that the flux generated by each winding must pass through the secondary core. The secondary core consists of a bypass half separated from a power half by a diamagnetic strip and magnetically neutral bonding agents. The secondary core's position in relation to the primary core is controlled through a push pull control rod or a gear mechanism by almost any type of actuator. The position of the secondary core determines the ratio of magnetic flux passing through the power end to the amount passing through the bypass end.

The amount of magnetic flux passing through the power end determines the flux density and hence the transformer secondary power output. The primary and secondary cores of this transformer can be of any shape that allows for moving the secondary core to vary the contact area ratio of the secondary power end to the bypass end between the primary core and the secondary core. The secondary core can either move in contact inside or outside of the primary core.

DETAILED DESCRIPTION OF THE DRAWINGS

Figure 1:
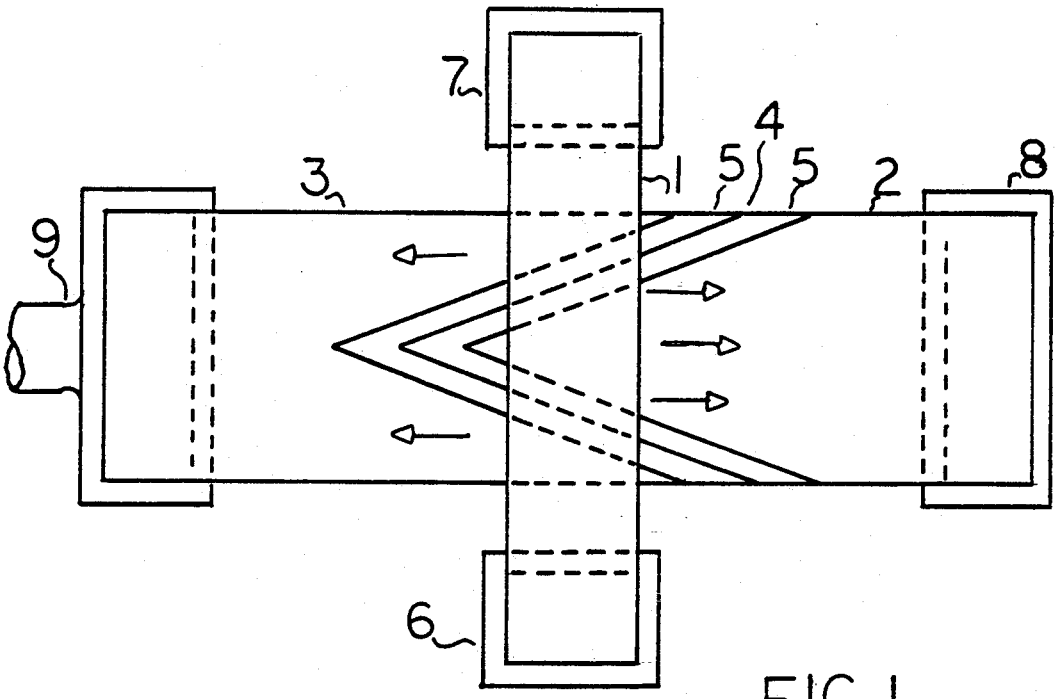
FIG. 1 is a plan view of the primary and secondary cores in relative positions showing the separation of the secondary bypass half and the power half. The primary and secondary conductors are omitted for clarity. The magnetic flux flow is indicated by arrows.
Figure 2:
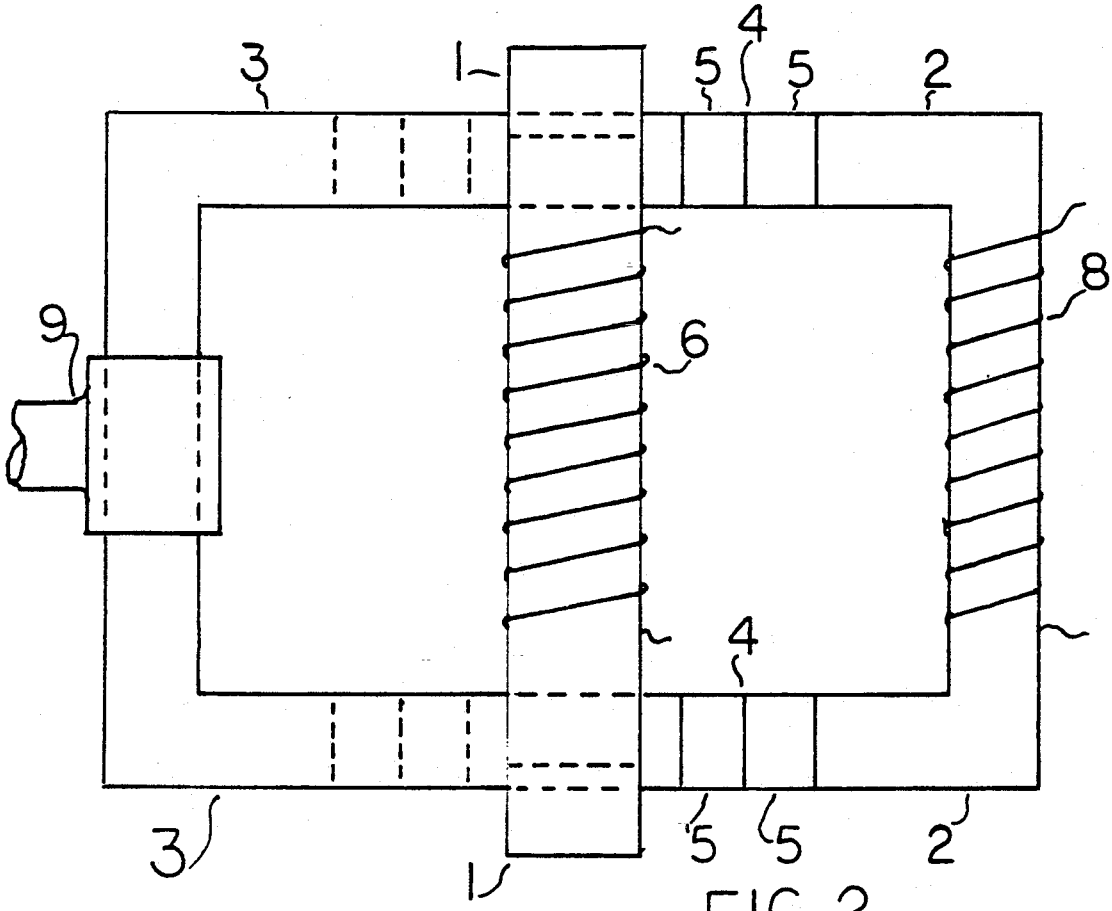
FIG. 2 is a side view of the primary and secondary cores with one power winding and the secondary winding shown.
Figure 3:
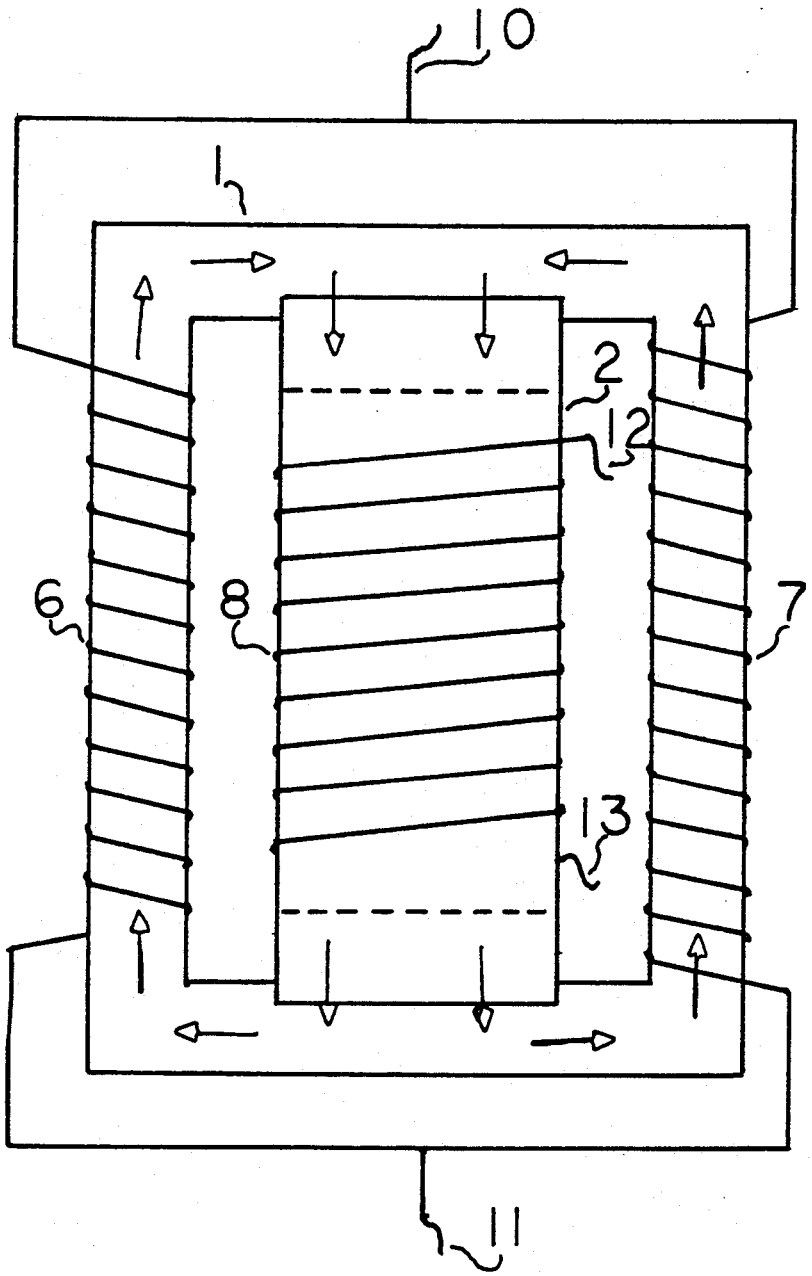
FIG. 3 is an end view showing both primary windings with their respective leads and the secondary winding with it's respective leads. Magnetic flux flow for one half cycle is indicated by arrows.

In the plan view FIG. 1 the primary core #1, the secondary power core half #2, the secondary bypass half #3, the diamagnetic strip #4 and nonmagnetic bonding material #5. The bottom view is a mirror image of the plan view. Primary coils #6 and #7 are wound in opposition so that the magnetic flux must travel through the secondary core. Said magnetic flux can flow either through the bypass core half, through the power core half or through both, dependent upon the relative position of the secondary core in relation to the primary core. The flux passing through the power half of the secondary core produces electrical energy flow through the secondary coil #8. The flux passing through the bypass half produces no electrical energy. Referring now to FIG. 2, a side view of the transformer the push pull rod #9 connected to a control device "not shown" that positions the secondary core to increase or decrease the magnetic flux passing through the power half of the secondary core and therefore changes the power transferred from the primary to the secondary windings. The diamagnetic strip #4 reduces flux leakage between the power half and the bypass half of the secondary core. Referring now to FIG. 3, a right side view of FIG. 1 the arrows indicate magnetic flux flow during one half cycle. The primary conductors #10 and #11 conduct primary current to or from primary windings #6 and #7. Secondary conductors #12 and #13 conduct secondary current to the load. It can readily be seen that this variable power transformer could easily be of many different configurations without materially affecting the concept of performance.

I claim:

1. A variable power transformer comprising: a primary core generally of a rectangular, toroidal shape with parallel sides and with primary windings wound in opposition on each end of said core, and a secondary core of a generally rectangular, toroidal shape with a secondary winding on one end of said secondary core with said secondary core comprising two halves separated by a non-magnetic material and constructed so as to slide through the primary core at an angle to the plane of the primary core constantantly maintaining contact with said primary core.

2. A variable power transformer of claim 1 with the secondary core halves having respective complimentary shaped ends which vary in width so as to change the relative area of contact between each half of said secondary core with the primary core as the cores move relative to each other.

3. The variable power transformer of claim 1 with the the two halves being a bypass half and a power half of the secondary core which are separated by a diamagnetic material.

* * * * *